United States Patent [19]

Beer

[11] Patent Number: 4,620,641

[45] Date of Patent: Nov. 4, 1986

[54] ACCESS PLUG FOR THREADED HOLES IN ELECTRIC STARTING APPARATUS

[75] Inventor: Arthur G. Beer, Anderson, Ind.

[73] Assignee: General Motors Corporation, Detroit, Mich.

[21] Appl. No.: 808,080

[22] Filed: Dec. 12, 1985

[51] Int. Cl.[4] ..... B65D 41/04

[52] U.S. Cl. ..... 220/288; 220/289; 220/307; 220/284

[58] Field of Search ..... 220/266, 269, 270, 276, 220/288, 289, 284, 307

[56] References Cited

U.S. PATENT DOCUMENTS

| | | | |
|---|---|---|---|
| 3,020,771 | 2/1962 | Redick et al. . | |
| 3,083,858 | 4/1963 | Biedenstein | 220/266 |
| 3,269,581 | 8/1966 | Calder . | |
| 3,399,798 | 9/1968 | Sentz . | |
| 3,578,200 | 5/1971 | Hetzer . | |
| 3,596,694 | 8/1971 | Jaeniche | 150/55 |
| 3,966,080 | 6/1976 | Bittel | 220/269 |
| 3,998,354 | 12/1976 | Song | 220/307 |
| 4,231,486 | 11/1980 | Bock | 220/307 |
| 4,280,634 | 7/1981 | Wisenberger et al. | 220/270 |
| 4,332,332 | 6/1982 | Ingemann | 220/276 |
| 4,334,632 | 6/1982 | Watanabe | 220/307 |
| 4,363,420 | 12/1982 | Andrews | 220/307 |
| 4,434,907 | 3/1984 | Ingemann | 220/270 |

*Primary Examiner*—George T. Hall

*Attorney, Agent, or Firm*—C. R. Meland

[57] ABSTRACT

An access plug for providing a removable closure for a threaded hole in a housing of an electric starter or the like. The access plug is formed of a plastic molding material and has a cap member and a retainer member that are joined by a thin annular frangible portion. When assembling the plug to the threaded hole the plug is aligned with the hole and one end of the plug engages the housing. A tool now applies an axial force to the plug which causes the retainer member to be inserted into the hole, causes the frangible portion to be sheared or broken and causes a portion of the cap member to be inserted into the retainer member. When the frangible portion breaks a bead on the retainer member remains which is engaged by a ratchet tooth of a series of ratchet teeth formed on a part of the cap member.

5 Claims, 4 Drawing Figures

ACCESS PLUG FOR THREADED HOLES IN ELECTRIC STARTING APPARATUS

This invention relates to access plugs for closing threaded access openings formed in a housing wall of apparatus such as a dynamoelectric machine and more particularly to an access plug for closing access openings in an electric starter or cranking motor.

In some electric starters, or cranking motors, removable access plugs are utilized to permit access to the interior of the starter to allow adjustment of certain internal parts of the starter. One type of such an access plug is disclosed in the U.S. Pat. No. to Redick et al. U.S. Pat. No. 3,020,771. In that patent a metallic access plug is threaded into a threaded opening formed in a housing that encloses the shift lever mechanism of the starter. When the access plug is removed, the shift lever mechanism is accessible from the exterior of the starter. Access plugs are also used to permit access to the brush rigging of electric starters. Thus, threaded openings can be provided in the starter motor wall adjacent the brushes of an electric starter which are closed by removable access plugs of the type disclosed in the above-referenced Redick et al. patent.

It is an object of this invention to provide an access plug for dynamoelectric machines and the like that, instead of being threaded into a threaded opening, can be fitted to the threaded opening by axially forcing the plug into the opening and snapping it into place. In the accomplishment of this object the access plug is formed as a one-piece molded plastic part that is comprised of two parts that are separated when the plug is assembled to a threaded hole. The two parts of the plug are joined by a thin frangible portion when the plug is molded. When the plug is assembled to a threaded opening or hole in the housing one end of the plug is aligned with the threaded opening and engages the housing. The plug is now axially impacted and as axial impact force is applied to the plug one of the parts (outer part) is forced into the threaded hole and after it is seated in the hole the frangible portion severs or breaks and the other part (inner part) is then forced into the outer part. The outer part has deflectable portions which are forced into the threads of the threaded opening to thereby retain the outer part fixed to the motor housing. The inner part has outer ratchet shaped teeth, one of which engages a part of the frangible portion that remains after the parts have been separated. Once the plug is assembled, as described, the inner part can be removed from the outer part by a suitable prying tool to thereby permit access to the interior of the starter. The inner part can be reassembled to the outer part by simply pushing the inner part into the outer part.

Another object of this invention is to provide an access plug of the type described wherein the outer part has a plurality of circumferentially spaced flexible portions or prongs which move inwardly when the plug is forced into the threaded opening and then are forced outwardly into engagement with the threads of threaded opening when the inner part is forced into the outer part and further wherein the outer part has axially extending internal ribs which engage ratchet teeth on the inner part to thereby cam or force the flexible portions outwardly against the threads of the threaded hole when the inner part is forced into the outer part.

IN THE DRAWINGS

Figure 1:
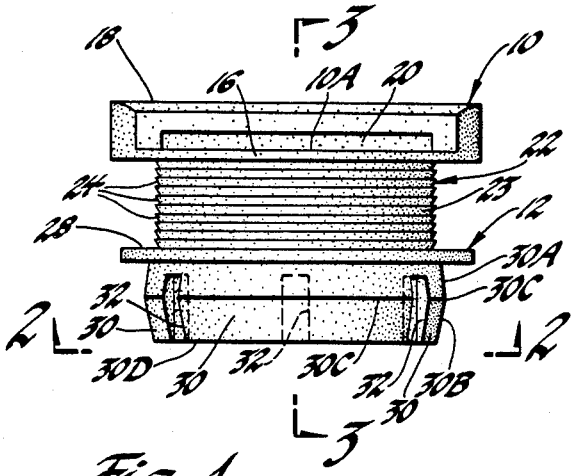
FIG. 1 is a plan view of an access plug made in accordance with this invention.
Figure 2:
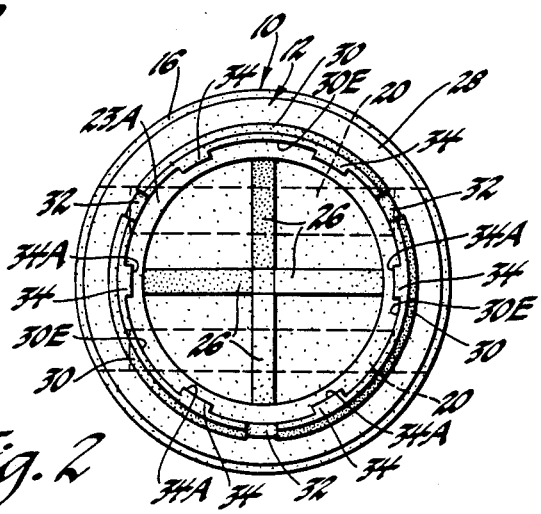
FIG. 2 is an end view of the access plug illustrated in FIG. 1, looking in the direction of arrows 2—2 of FIG. 1.
Figure 3:
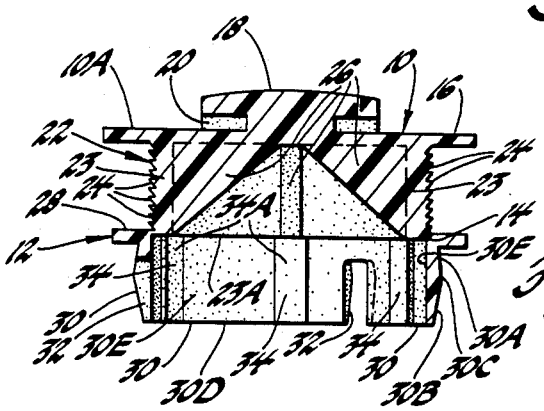
FIG. 3 is a sectional view, taken along lines 3—3 of FIG. 2.

Referring now to the drawings and more particularly to FIGS. 1–3, it is seen that the access plug of this invention, prior to being assembled to the housing of a starter, is comprised of a cap member or part generally designated by reference numeral 10 which is joined to a cap retaining member or part generally designated by reference numeral 12 by a thin annular frangible portion 14. As will be more fully described hereinafter the plug, when assembled to a threaded opening in a starter motor housing, is axially impacted to shear or sever the frangible portion 14 to thereby separate the one-piece plug into two separate parts 10 and 12. The plug is formed of a thermoplastic molding material such as nylon and is formed to the shape illustrated in FIGS. 1–3 by molding it to that shape. One specific type of thermoplastic material that can be used as the molding material for the plug is a nylon resin available from the Du Pont Co. and identified as "ZYTEL" ST-811 HS nylon resin. During the molding of this plug, a measured amount of flash is utilized to form the frangible or shearable portion 14.

The cap member 10 has an annular flange 16, a head portion 18 formed with side recesses 20 and a tubular portion 22 defined by an annular axially extending wall 23. The external surface of the wall 23 is provided with a plurality of annular axially spaced ratchet shaped teeth 24 that are disposed along the entire length of the outer surface of the annular wall 23. Each of the ratchet shaped teeth extend around the entire circumference of wall 23. The interior of the cap member is provided with four strengthening ribs 26 having slanted internal surfaces.

The cap retainer part or member 12 has an annular flange 28 and three arcuately extending flexible portions or locking prongs 30 located between and defined by three slots 32. Each prong or portion 30 extends axially of flange 28 and each prong has tapered portions 30A and 30B which may be termed as conically shaped surfaces. The tapered portions 30A and 30B merge along a surface edge 30C of a prong which is the largest diameter portion of the prongs.

The flexible portions or prongs 30 each have two internal axially extending ribs 34. With this arrangement a total of six ribs is provided and the ribs 34 are disposed 60° apart. A given pair of ribs 34 are diametrically opposed as is evident from an inspection of FIG. 2. The ribs 34 extend axially from edges 30D of prongs 30 to a point adjacent the annular end wall 23A of wall 23.

The outermost marginal edges of the ratchet teeth 24 are located slightly radially outwardly of the arcuately extending inner surfaces 30E of the prongs 30 and these outer marginal edges of ratchet teeth 24 are located radially outwardly of the inner arcuately extending surfaces 34A of ribs 34. When the cap member 10 is axially forced into the retainer member 12, in a manner to be described, the outer edges of the ratchet teeth 24 engage the inner surfaces 34A of ribs 34 to thereby force or cam the prongs 30 radially outwardly.

Figure 4:
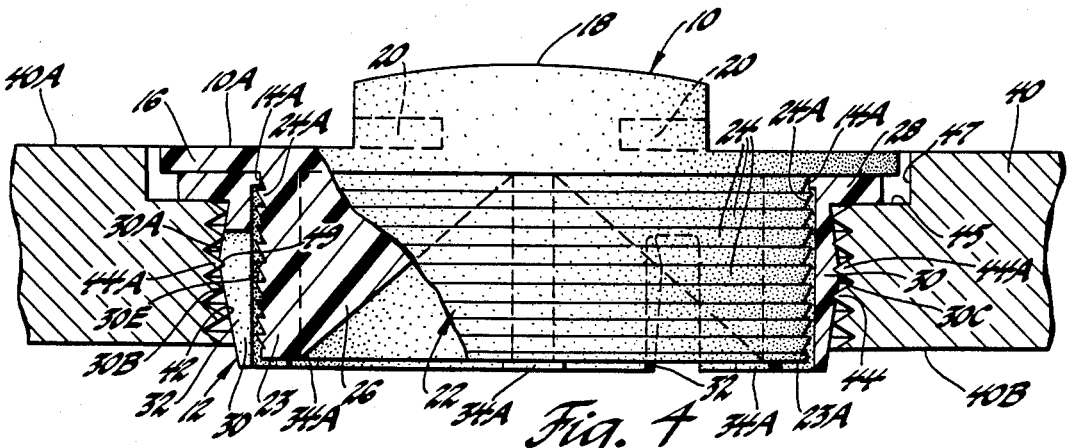
FIG. 4 is a sectional view illustrating the access plug of this invention assembled to a threaded opening in a housing of an electric starter.

The manner in which the access plug, that has been described, is assembled to a threaded opening in the housing of an electric cranking motor will now be described in connection with FIG. 4. In FIG. 4 the reference numeral 40 designates the steel wall of the housing of an electric cranking motor of the type disclosed in the above-referenced Redick et al. U.S. Pat. No. 3,020,771. The wall 40 has an exterior surface 40A and an internal surface 40B. The wall 40 has a circular threaded hole, or opening 42, extending therethrough which has internal helical threads 44. The threaded hole is aligned with a counterbore defined by annular surfaces 45 and 47 which is located at the exterior of the starter housing. In FIG. 4 the access plug of this invention is illustrated in its assembled condition where the cap member 10 has been forced into cap retainer member 12 and where cap retainer member 12 has been forced into threaded opening 42.

When the access plug, shown in FIGS. 1–3, is assembled to the threaded opening 42 the plug is positioned such that the portions of the outer conical surfaces 30B of the prongs 30 seat against one of the threads of threads 44 that is located adjacent outer housing surface 40A. The ends of prongs 30 are now partially inserted into threaded hole 42. With the plug in this position a tool, (not illustrated) engages the head 18 and surface 10A of cap member 10 to impact or force the access plug toward and into threaded opening 42. The device that develops the impacting force may be an impact air hammer. The impacting tool has a slot to accommodate the head portion 18 and has a surface engaging surface 10A. This force or impact first causes the prongs 30 to be fully inserted into the threaded opening 42. The prongs 30 flex radially inwardly as they are inserted into the threaded opening since outer surfaces of the prongs engage the threads 44. As the prongs 30 are being pushed by the tool into the threaded hole the flange 28 will eventually be forced into contact with the surface 45 of wall 40. When this happens the continued axial movement of the impact tool will now cause the frangible portion 14 to be sheared or broken with the result that parts 10 and 12 are now separated and the tubular portion 22 of part 10 is now forcibly inserted into the prongs 30. The continued movement of the impact or forcing tool will move the tubular portion 22 axially until the lower surface of flange 16 engages the top surface of flange 28.

When the frangible portion 14 is sheared or broken an annular bead 14A, shown in FIG. 4, is formed, that is, a portion 14A of frangible portion 14 remains connected to retainer member 12. This bead 14A extends radially inwardly by a very small amount, but by an amount that is sufficient to engage or hook behind the top ratchet tooth 24A of the ratchet teeth when tubular portion 22 is fully inserted into prongs 30, that is, when flanges 16 and 28 become engaged. Thus, as the tubular portion 22 of cap member 10 is forced into the prongs 30 of retainer 12 the ratchet teeth 24 ratchet over the bead 14A and eventually the ratchet tooth 24A becomes positioned behind bead 14A. The slanting surfaces of ratchet teeth 24 are so slanted as to permit the teeth to slide or ratchet over the bead 14A.

When the tubular portion 22 of cap 10 is inserted into prongs 30 the outer marginal edges of ratchet teeth 24 engage the inner surfaces 34A of ribs 34. This action causes the prongs 30 to be deflected radially outwardly so that portions of the thread 44 bite into outer surfaces of the prongs 30. This is illustrated in FIG. 4 where it is seen that thread 44A has bit into outer surfaces of prongs 30 to form a groove 49 in the outer surfaces of prongs 30. This groove substantially coincides with the largest diameter portions 30C of prongs 30. The number of threads that bite into the outer surface of prongs 30 will vary, dependent upon the dimensions of the parts.

In the final assembled position of the access plug to the threaded hole, as illustrated in FIG. 4, the retainer member 12 is fixed to the housing 40 by virtue of the fact that portions of the threads 44 bite into the outer surfaces of prongs 30 and due to the fact that once the prongs 30 have been forced outwardly by ratchet teeth 24 they tend to remain engaged with portions of the threads 44 due to the elasticity of the plastic material of the access plug.

When the access plug has been assembled, as shown in FIG. 4, the user of the electric starter can remove the cap member 10 to gain access to the interior of the starter. The cap member 10 is axially retained in retainer member 12 by the fact that ratchet tooth 24A has been locked behind bead 14A and by the frictional engagement of ratchet teeth 24 with surfaces 34A of ribs 34. To remove cap 10, a suitable prying tool may be utilized to force the tubular portion 22 out of the prongs 30. The tool may be inserted into recesses 20.

When cap member 10 has been removed and the user has completed any internal adjustment of parts of the starter the tubular portion 22 of cap member 10 is inserted into the prongs 30 to cause the cap member 10 to be secured to the retainer 12. The tubular portion is pushed in until ratchet tooth 24A locks behind bead 14A. In the event that tubular portion 22 is not pushed all the way into retainer 12 at least one of the ratchet teeth 24 will lock behind bead 14A to retain the cap member 10 secured to retainer 12.

In summary, it will be appreciated that the access plug of this invention is simply assembled to a threaded hole in a housing by aligning the plug with the hole such that one end of the plug engages a part of the housing and then applying an axial force to the plug. This axial force first causes the retainer 12 to be seated in the hole, it then causes the frangible portion 14 to be broken or sheared and it then causes the tubular portion 22 of cap 10 to be fully inserted in prongs 30 of retainer 12. The impact force applied to the access plug must be enough to cause prongs 30 to be inserted into the threaded hole and enough to cause frangible portion 14 to be sheared or broken and tubular portion 22 forced into prongs 30.

The embodiments of the invention in which an exclusive property or privilege is claimed are defined as follows:

1. An access plug for providing a removable closure for a threaded hole that is formed in a metallic housing wherein the plug has a portion that is adapted to be axially moved into the threaded hole when the plug is assembled to the hole comprising, a one-piece plastic part having a cap member and a cap retainer member, said cap member having an axially extending tubular portion the outer surface of which is defined by a plurality of annular axially spaced ratchet shaped teeth, said cap retainer member having an annular portion and a plurality of arcuately extending prongs that are joined to said annular portion and which extend axially therefrom, said prongs being radially deflectable, said cap member and retainer member being axially spaced from each other and being joined by a thin annular frangible portion that is connected to said annular portion of said retainer member and one end of said tubular portion of said cap member, said frangible portion being broken when an axial force is applied to said cap member to insert the retainer member in said hole whereby the cap member and retainer member are separated and said tubular portion of said cap member is forced into the interior of said prongs, said retainer member having a radially inwardly extending annular bead that is formed from a portion of said frangible portion when it is broken, the inner diameter of said bead and the outer diameter of said ratchet teeth being such that said ratchet teeth slide over said bead when said tubular portion is inserted into said prongs and such that a ratchet tooth engages said bead to secure said cap member to said retainer member, said ratchet teeth engaging internal surfaces of said prongs to deflect said prongs radially outwardly into tight engagement with the threaded portion of said hole.

2. An access plug for providing a removable closure for a threaded hole that is formed in a metallic housing wherein the plug has a portion that is adapted to be axially moved into the threaded hole when the plug is assembled to the the hole comprising, a one-piece plastic part having a cap member and a cap retainer member, said cap member having an axially extending tubular portion the outer surface of which is defined by a plurality of annular axially spaced ratchet shaped teeth, said cap retainer member having an annular portion and a plurality of arcuately extending prongs that are joined to said annular portion and which extend axially therefrom, said prongs being radially deflectable, each said prong having at least one axially extending rib that extends radially inwardly from an inner surface of a prong, said cap member and retainer member being axially spaced from each other and being joined by a thin annular frangible portion that is connected to said annular portion of said retainer member and one end of said tubular portion of said cap member, said frangible portion being broken when an axial force is applied to said cap member to insert the retainer member in said hole whereby the cap member and retainer member are separated and said tubular portion of said cap member is forced into the interior of said prongs, said retainer member having a radially inwardly extending annular bead that is formed from a portion of said frangible portion when it is broken, the inner diameter of said bead and the outer diameter of said ratchet teeth being such that said ratchet teeth slide over said bead when said tubular portion is inserted into said prongs and such that a ratchet tooth engages said bead to secure said cap member to said retainer member, said ratchet teeth engaging internal surfaces of said ribs on said prongs to deflect said prongs radially outwardly into tight engagement with the threaded portion of said hole.

3. A removable closure for a threaded hole that is formed in a metallic housing comprising, a metallic housing having a hole extending therethrough, the wall defining the hole having threads, a retainer member formed of plastic material having an annular flange engaging said housing, said retainer member having a plurality of radially deflectable prongs extending axially from said annular flange located within said hole with portions of the outer surfaces of said prongs engaging said threads in such a manner that at least one of said threads bites into outer surface portions of said prongs, and a cap member formed of plastic material having a tubular portion disposed within said prongs, the outer surface of said tubular portion having a plurality of annular axially spaced ratchet shaped teeth that engage internal surfaces of said prongs, said cap member and retainer member being initially joined by a thin annular frangible portion which is broken when said retainer member is forced into said hole by the application of an axial force to said cap member, said retainer member having a radially inwardly extending annular bead that is formed from a portion of said frangible portion when it is broken, one of said ratchet teeth engaging said bead to retain said cap member secured to said retainer member.

4. The closure according to claim 3 wherein the internal surfaces of the prongs that are engaged by said ratchet teeth are internal surfaces of ribs that extend radially inwardly from internal surfaces of said prongs.

5. A removable access closure for a threaded hole in a housing of an electric starter comprising, a hole extending through said housing, the wall defining said hole having threads, a retainer member formed of plastic material having an annular flange engaging said housing, said retainer member having a plurality of radially deflectable prongs extending axially from said annular flange located within said hole with portions of the outer surfaces of said prongs having at least one groove, at least one of said threads being located in said groove, and a cap member formed of plastic material having a tubular portion disposed within said prongs the outer surface of said tubular portion having a plurality of annular axially spaced ratchet shaped teeth that engage internal surfaces of said prongs, said cap member and retainer member being initially joined by a thin annular frangible portion which is broken when said retainer member is forced into said hole by the application of an axial force to said cap member, said retainer member having a radially inwardly extending annular bead that is formed from a portion of said frangible portion when it is broken, one of said ratchet teeth engaging said bead to retain said cap member secured to said retainer member, said cap member being removable from said retainer member to permit access to the interior of said starter housing.

* * * * *